US007614531B2

(12) United States Patent
Kawakita

(10) Patent No.: US 7,614,531 B2
(45) Date of Patent: Nov. 10, 2009

(54) EXTENDABLE STRAP DEVICE

(76) Inventor: Kijuro Kawakita, B504, 482-22, Hasamacho 2-chome, Funabashi-shi, Chiba 2740822 (JP)

( * ) Notice: Subject to any disclaimer, the term of this patent is extended or adjusted under 35 U.S.C. 154(b) by 289 days.

(21) Appl. No.: 11/483,627

(22) Filed: Jul. 11, 2006

(65) Prior Publication Data

US 2006/0260725 A1 Nov. 23, 2006

Related U.S. Application Data

(63) Continuation of application No. PCT/JP2005/000554, filed on Jan. 12, 2005.

(30) Foreign Application Priority Data

Jan. 12, 2004 (JP) ..... 2004-035755

(51) Int. Cl.
*A45C 13/26* (2006.01)
*A45C 13/30* (2006.01)

(52) U.S. Cl. ..... 224/101; 224/579; 224/258; 224/908; 224/930; 150/108

(58) Field of Classification Search ..... 224/101, 224/150, 578, 579; 150/107, 108, 110
See application file for complete search history.

(56) References Cited

U.S. PATENT DOCUMENTS

| | | | | |
|---|---|---|---|---|
| 1,210,475 | A * | 1/1917 | Hooper | 224/150 |
| 3,441,185 | A * | 4/1969 | Moomaw | 224/150 |
| 3,559,853 | A | 2/1971 | Strassman | |
| 4,562,945 | A * | 1/1986 | Erlandson | 224/150 |
| 5,437,401 | A * | 8/1995 | Seltzer | 224/578 |
| 5,547,052 | A * | 8/1996 | Latshaw | 190/108 |
| 5,950,893 | A | 9/1999 | Heggeland | |
| 6,669,068 | B2 * | 12/2003 | Kawakita | 224/578 |
| 2002/0129439 | A1 | 9/2002 | Kawakita | |

FOREIGN PATENT DOCUMENTS

| | | |
|---|---|---|
| JP | U 51-141126 | 11/1976 |
| JP | U 63-77526 | 5/1988 |
| JP | A 2001-46138 | 2/2001 |
| JP | A 2002-159320 | 6/2002 |
| JP | A 2002-345535 | 12/2002 |

* cited by examiner

*Primary Examiner*—Tri M Mai
(74) *Attorney, Agent, or Firm*—Oliff & Berridge, PLC

(57) ABSTRACT

A strap device has a first guide having a first slit (7*a*), a third slit (7*b*), and an intermediate member (3*b*) defined therebetween; a single strap (11) connected at one end to the intermediate member (3*b*); and a second guide (5) that is movably provided opposite the first guide (3), on which a second slit (9*a*) and a fourth slit (9*b*) are formed, and that has an intermediate member (5*b*) defined between the second and fourth slits. The other end (11*b*) of the strap passes through the second slit (9*a*), the fourth (9*b*), third (7*b*), first (7*a*), and second (9*a*) slits in that order. When the other end (11*b*) of the strap is drawn away from the second guide (5), the strap is pulled out to three times the original length, and when the second guide (5) is drawn away from the first guide, the strap becomes the original length.

6 Claims, 6 Drawing Sheets

EXTENDABLE STRAP DEVICE

CROSS-REFERENCE

This application is a Continuation Application of International Application No. PCT/JP2005/000554 which was filed on Jan. 12, 2005 claiming the conventional priority of Japanese patent Application No. 2004-035755 filed on Jan. 12, 2004.

BACKGROUND OF THE INVENTION

1. Field of the Invention

The present invention relates to an extendable/contractible strap device which is usable for a mobile-phone or a bag.

2. Background of the Invention

A bag, to which a shoulder strap (shoulder belt) is attached, is convenient, for example, when the load of a bag is heavy or when the hands of a user are intended to be made free, because the bag can be retained by hanging the shoulder strap on the shoulder. However, when the shoulder strap is not used, the shoulder strap hangs down from the main body of the bag, which gives an unseemly appearance. Further, there some problems in which the shoulder strap hanging down from the main body of the bag may be caught by any object or obstacle, possibly resulting in an accident in some cases and in which the shoulder strap contacts with the floor, which is unfavorable in view of hygiene.

Japanese Patent No. 3359627 corresponding to U.S. Pat. No. 6,669,068 to the present inventor discloses an extendable/contractible strap which is provided with two sliders (guides) movable on straps. This strap was innovative because the strap device can extend to three or four times of original length on demand. However, because one slider is located in the middle of the strap when it is extended, it needs to prevent from interfering the slider with user's body. Further, when it is accommodated (contracted), an inconvenient operation using both hands is necessary to part the two sliders from each other.

Various types of straps are used for mobile-phones or key rings. Because ordinary ring-like straps do not change in length, they are not convenient although it has a clip on the end of the strap. A coil-like strap which is extendable is commercially available, but it cannot support a phone when a portion of the coil-like strap is held, like the ring-like strap. Thus, there might be a demand for a strap which can be easily handled and is extendable.

SUMMARY OF THE INVENTION

An object of the present invention is to overcome the inconvenience of the related art and provide a new strap having a structure which enables the strap to be shortened or accommodated by a single-handed operation.

According to a first aspect of the present invention, there is provided an extendable/contractible strap device (15) comprising a first guide (3) which is formed with a first slit (7*a*) and a third slit (7*b*) and a first intermediate part (3*b*) defined between the first slit and the third slit; a strap (11) which has a first end (11*a*) connected to the first intermediate part (3*b*); a second guide (5) which is arranged opposite to the first guide (3) and which is formed with a second slit (9*a*) and a fourth slit (9*b*) and a second intermediate part (5*b*) defined between the second slit and the fourth slit; wherein a second end (11*b*) of the strap passes through the second slit (9*a*) and the fourth slit(9*b*), and returns to the first guide, which subsequently passes through the third slit (7*b*) and the first slit (7*a*) of the first guide, and returns to the second guide, and subsequently passes through the second slit (9*a*) of the second guide. The strap extends to three times the original length when the second end (11*b*) is pulled away from the second guide. When the second guide (5) is moved apart from the first guide (3) the strap returns to the original length. A connecting member (20) may be connected to the free end of the strap (11*b*) to which an object, for example, a mobile phone, may be attached thereon. Such a member may be a ring through which the strap passes.

According to a second aspect of the present invention, there is provided an extendable/contractible strap device (15) comprising a strap (11); a ring (13) with an opening through which the strap (11) passes; a guide (5) which is arranged opposite the ring (13) and which is formed with a second slit (9*a*) and a fourth slit (9*b*) and an intermediate part (5*b*) defined between the second slit (9*a*) and the fourth slit (9*b*); wherein an end of the strap is connected to the ring (13) or the intermediate part (5*b*), and the other end (11*b*) of the strap passes through the second slit (9*a*) and the fourth slit (9*b*), returns to the ring (13), and subsequently passes through the opening to return to the guide (5), and subsequently passes through the second slit (9*a*) of the guide.

According to the second aspect of the invention, the strap device can be easily extended to a length more than three times longer than the contracted length. When the strap is not utilized, the strap device can be contracted to a length which does not cause any trouble. When the strap is needed, it can be quickly extended to a sufficient length. In particular, since it is possible to pull only one guide to perform the contracting operation, it is easy to operate. Because the strap device of the invention has only one strap and only one connecting point between the strap and the guide, it results in a simpler structure and is less expensive in terms of manufacturing costs than the strap device of Japanese Patent No. 3359627. When the new strap used as a shoulder strap is extended, the guides do not touch the user's body because the guides are located at opposite ends of the strap. Further, it has simple design. As shown in FIG. 8, it may form a ring-like strap to be used as a mobile-phone strap, by sliding one slider to contact the other slider.

DESCRIPTION OF THE PREFERRED EMBODIMENT OF THE INVENTION

Figure 1A:
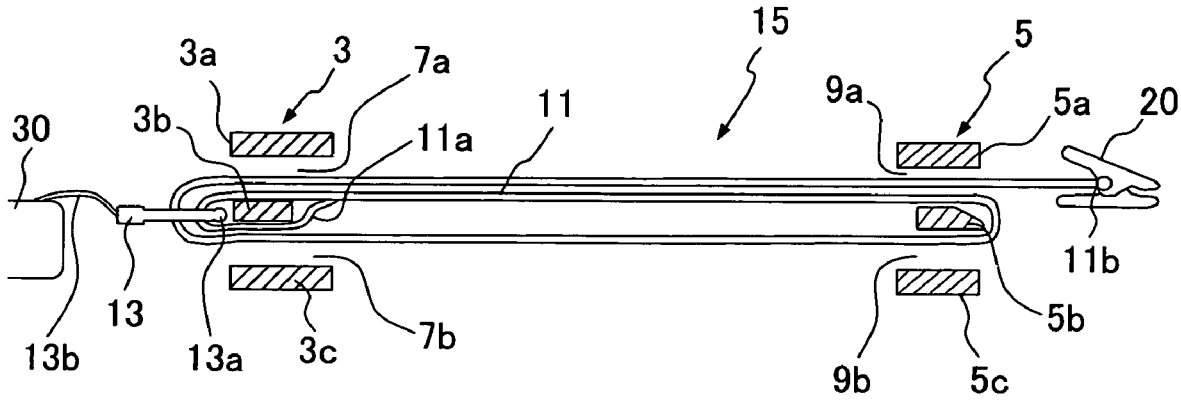
FIG. 1A shows a schematic view illustrating the structure of the strap device of the present invention.
Figure 1B:
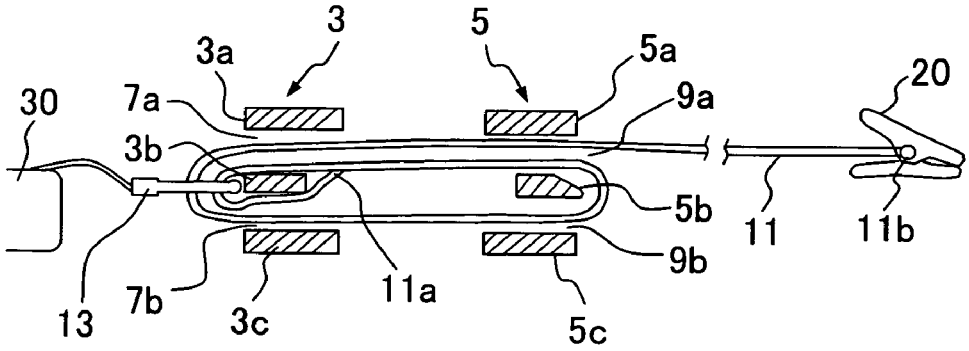
FIG. 1B shows a schematic view illustrating the strap device when it is extended.

In this specification, the term "slit" means an opening having a narrow and rectangular configuration as well as openings with arbitrary cross-sectional configurations including, for example, circular, elliptic, and square configurations. The term "strap" means a long member such as a string, a cord, a tape, sheet or the like, having not only a slender and rectangular cross-sectional configuration but also elliptic or circular configurations. The long member is formed from any material, such as leather, artificial leather, cloth, or synthetic tape, like plastic tape or paper. The long member, the core or the surface of the member may be formed of electro-conductive material.

First Embodiment

A first embodiment of the strap of the present invention will be explained with reference to FIGS. 1A to 1C, 2, and 3. A strap device 15 comprises a first guide 3, a second guide 5, a strap (strap tape) 11, and a connecting ring 13. A first end 11*a* of the strap 11 is secured to the first guide 3, and the other end 11*b* of strap 11 is secured to clip 20.

The first guide 3 is connected to an object, like a mobile-phone 30 through ring 13 and string 13*b*. The ring 13 has an opening 13*c* formed thereon, through which the strap passes (See FIG. 3). The ring may have any shape, such as circular or rectangular.

Figure 3:
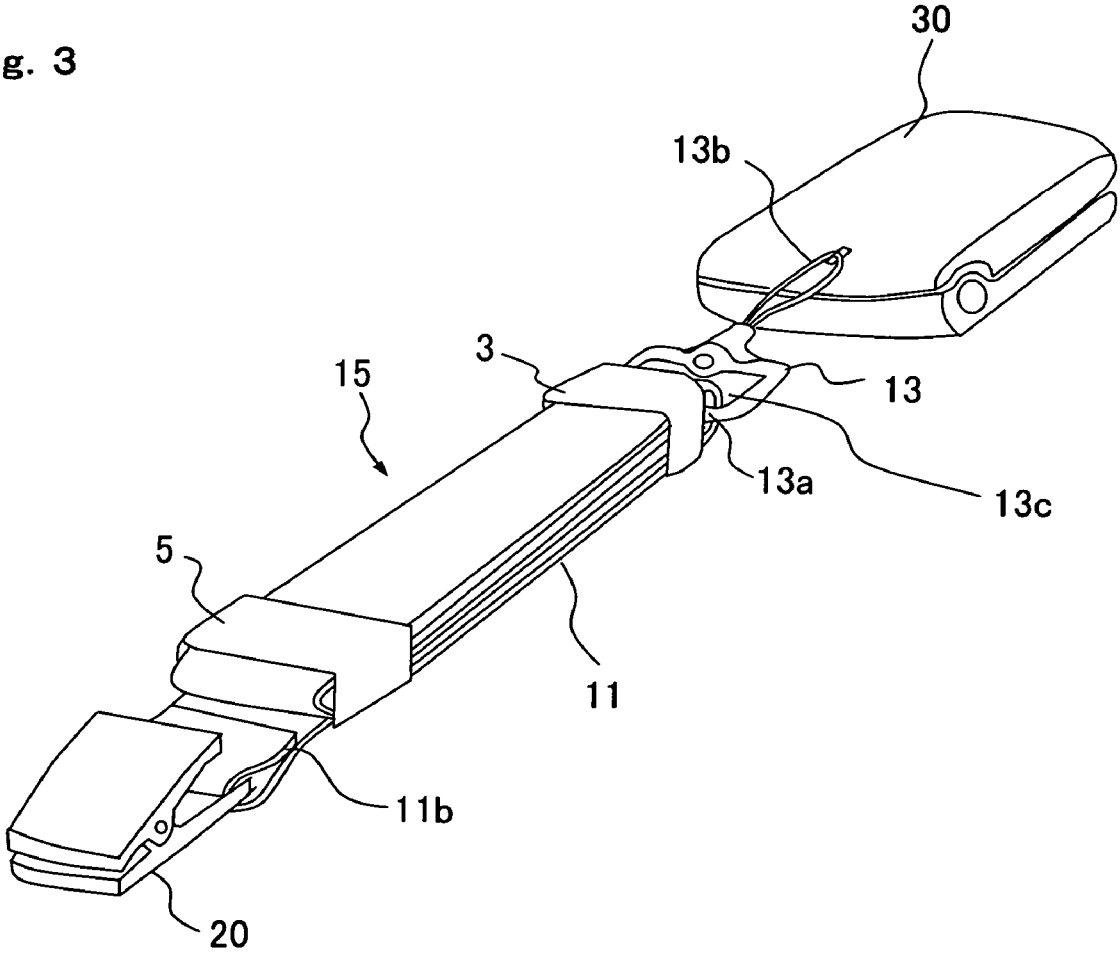
FIG. 3 shows a perspective view illustrating the strap device when it is connected to a mobile-phone.

As shown in FIG. 1A and 3, the first guide 3 is a substantially rectangular frame (hollow or box structure), and a slit 7*a* is formed between an upper surface 3*a* and a central portion (intermediate part) 3*b* and a slit 7*b* is formed between a lower surface 3*c* and the central portion 3*b*. The slits 7*a*, 7*b* and the central portion 3*b* extend parallel to each other in a lengthwise direction of the strap (right and left directions of the drawing). Slits 7*a* and 7*b* have a height of more than two times a thickness of strap 11 and a width which is slightly wider than that of strap 11. A first end 11*a* of strap 11 is secured to the central member 3*b*, for example by stitching. The first strap 11 is composed of a flexible, tape-like member with a smooth surface, such as polypropylene, polyethylene or nylon.

As shown in FIGS. 1A and 3, the second guide (slider) 5 is a substantially rectangular frame which has the same structure and is formed of the same material as the first guide 3. A slit 9*a* is formed between the upper surface 5*a* and a central portion 5*b* and a slit 9*b* is formed between a lower surface 5*c* and the central portion 5*b*. Slit 9*a* extends parallel to slit 9*b*. The height of slit 9*b* may be the same as or half that of slit 9*b*. The central portion 5*b* of the second guide 5 has an upper surface (the surface facing the upper surface 5*a* of the second guide 5 which is inclined with angle θ with respect to the lengthwise direction of the strap 11 at one side of the clip 20. In other words, the central portion 5*b* is tapered towards the other end 11*b* of the strap (or towards the clip 20) and is asymmetrical with respect to the lengthwise direction of the strap 11.

As shown in FIG. 1A, the second guide 5 is arranged opposite to the first guide 3 so as to be movable relative to the first guide 3. The other end 11*b* of the strap 11 which the end 11*b* is secured to the central portion 3*b* of the first guide 3 extends toward the second guide 5, and passes through the slit 9*a* of the second guide 5. The other end 11*b* passes through the slit 9*a* returns to pass through the slit 9*b* to the first guide 3. Subsequently, the other end 11*b* passes through the slit 7*b* of the first guide 3 and returns to the first guide 3 by passing through the opening (13*c*) of the ring 13, and passes through the slit 7*a* to the second guide 5, and passes through the slit 9*a* to arrive at the outside of an area defined between the first guide 3 and the second guide 5 as shown in FIG. 1A. As noted from FIG. 1A, the strap 11 runs between the first guide 3 and the second guide 5, 1.5 times, and thus the strap 11 overlaps as three layers between the first guide 3 and the second guide 5.

Next, the operation of the strap device 15 will be explained. In the strap device 15 shown in FIG. 1A, a mobile-phone is held in one hand, and the clip 20 connected to the end 11*b* of the strap 11 is pulled apart from the second guide 5 using the other hand. Through this operation, the second guide 5 is moved towards the first guide 3 while the strap is withdrawn from the first guide 3 and the second guide 5. Further, by pulling the other end 11*b* apart from the second guide 5, the second guide 5 contacts with the first guide 3 so that the strap cannot be withdrawn any more, as shown is FIG. 1C. At this moment, the substantial length of the strap which corresponds to a length three times the distance between the first guide 3 and the second guide 5 in a state of the strap device 15 shown in FIG. 1A.

Figure 2:
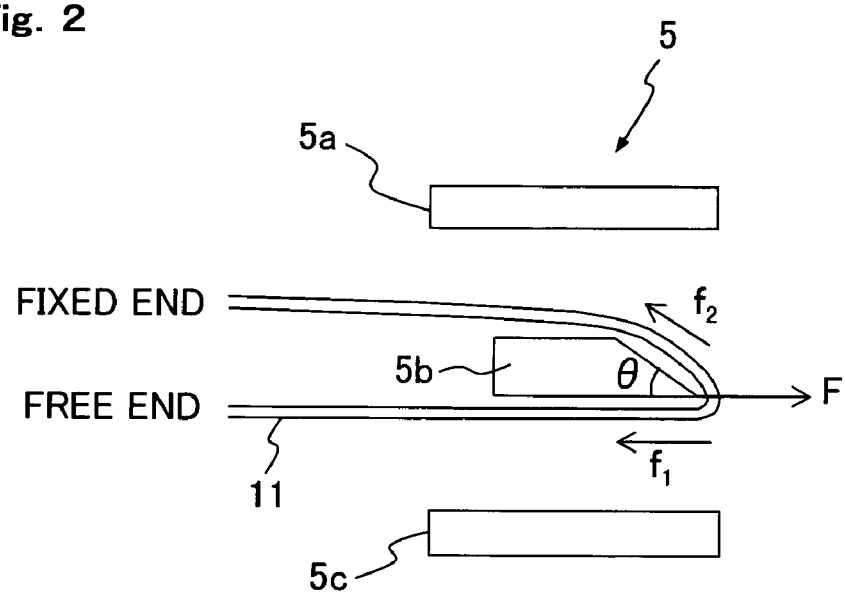
FIG. 2 shows a sectional view of the second guide.

In order to return to the original state as shown in FIGS. 1A and 2, it is sufficient to pull the second guide 5 away from the first guide 3. Namely, it is sufficient to pull the second guide 5 apart from the first guide using one hand while holding the mobile-phone 30 in the other hand. At this moment, the outer, upper surface of the central portion 5*b* is inclined at an angle θ (for example 45-60 degrees) with respect to the lengthwise direction of the strap 11. Accordingly, the force exerted is not equal at both end 11*a* (the fixed end) and the other end 11*b* (the free end). In the other words, when the second guide 5 is pulled apart from the first guide 3 by a force F, the proportion between force F1 exerted to the free end and force F2 exerted to the fixed end is expressed as f1:f2=1: cos θ. Thus, since side 11*b* of the strap which is the free end is pulled more strongly than the fixed side, the withdrawn strap 11 is smoothly accommodated between the guides. As a result, a strap device is realized which can be accommodated by operating only one guide (5) of the two guides.

Figure 1C:
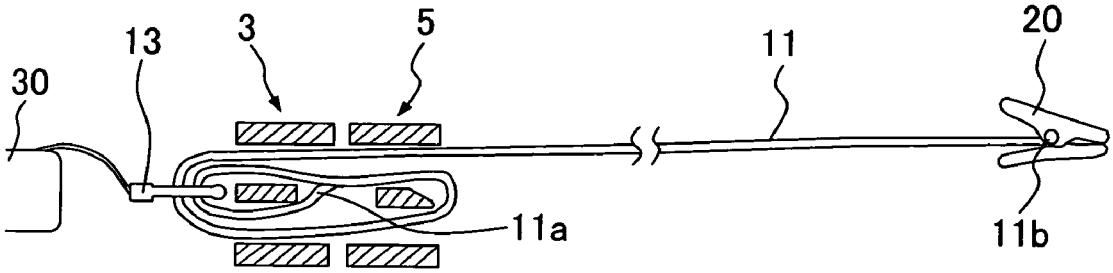
FIG. 1C shows a schematic view illustrating the state in which the strap device is fully extended.
Figure 8:
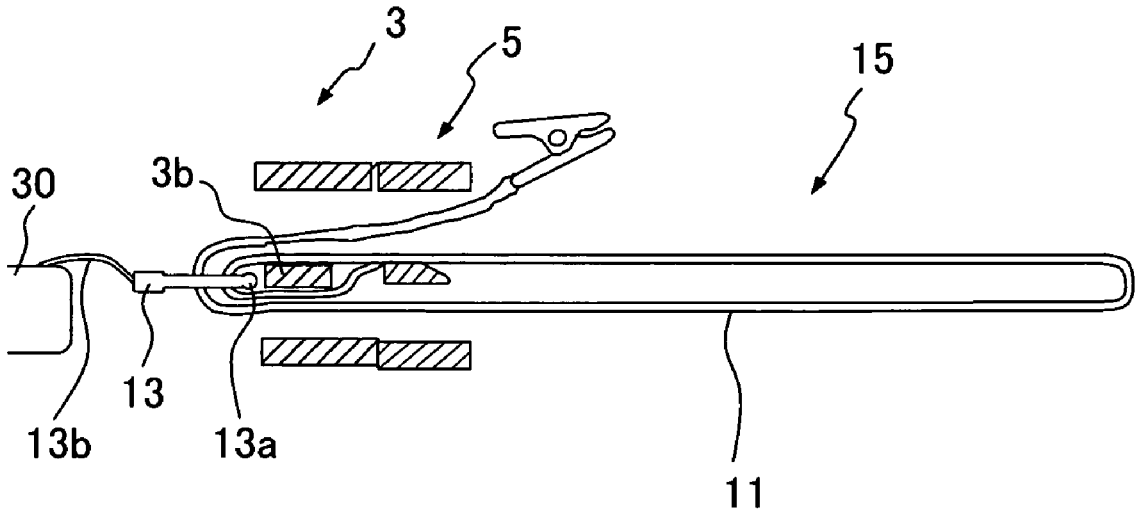
FIG. 8 shows a schematic view illustrating an embodiment in which a strap of the strap device is used in a ring-like form.

In a state of the strap device, as shown in FIG. 1A, when the guide (slider) 3 is moved to the side of guide (slider) 5 to draw the ring-like portion (right side portion in FIG. 1A) of strap 11, the end of the strap which is provided with the clip (20) is drawn into sliders 3 and 5. In this state, a user can hold the strap by inserting their finger in the ring-like portion, in a similar manner to a normal mobile phone strap, or hang the ring-like portion on a hook, because strap 11 of the ring-like portion is drawn to a sufficient length. Attention should be paid to the following matters. The strap device, as shown in FIG. 8, has a longer total length than the length shown in FIG. 1A, wherein the strap is accommodated to be overlapped as three layers. As a result, the strap device can be in three different states:

i) an accommodated state, as shown in FIG. 1A, in which the strap is accommodated to have an original length;

ii) a ring-like state, as shown in FIG. 8, in which the strap is twice the original length;

iii) an extended state, as shown in FIG. 1C, in which the strap is drawn to three times the original length.

The user can choose one of these states by adjusting the position of the slider depending on usage.

The strap device, shown in FIG. 1, may omit slider 3. In this case, the strap can run around ring 13 and slider 5, and extension and contraction can be smoothly performed because contact resistance of the strap with the guide can be reduced due to the absence of guide 3.

Second Embodiment

Figure 4A:
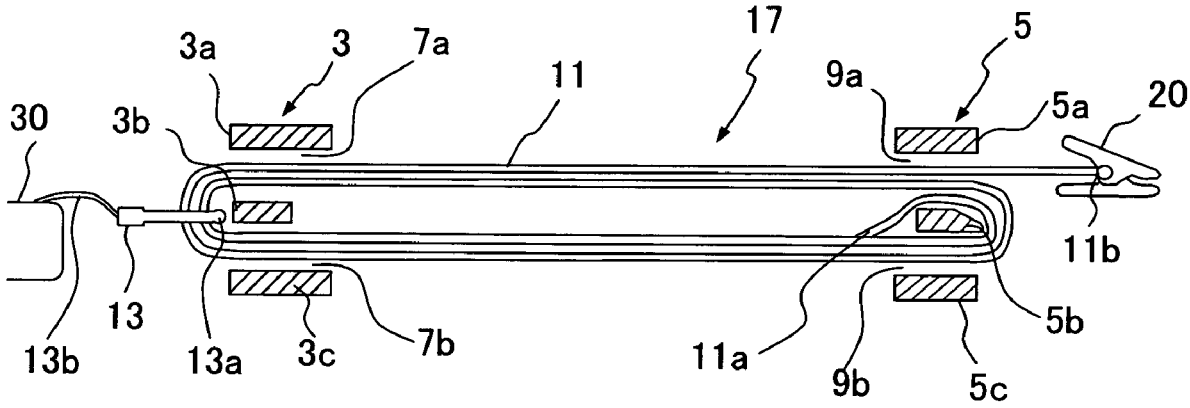
FIGS. 4A and 4B show a sectional view of the strap device which is extendable to four times the contracted length.
Figure 4B:
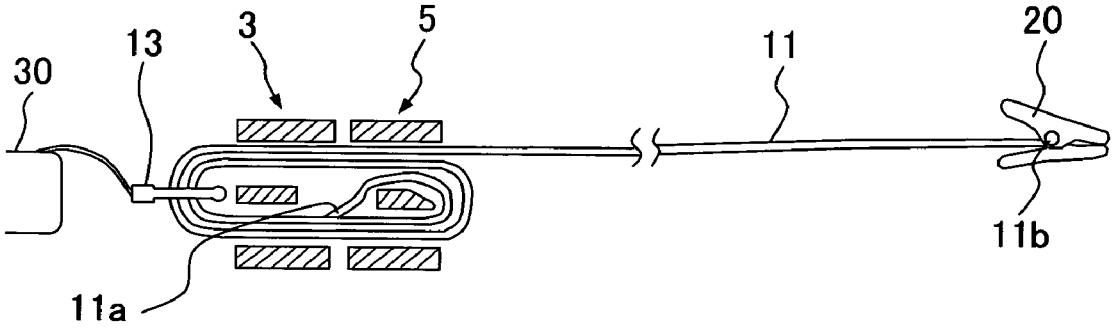

A second embodiment of the strap of the present invention will be explained with reference to FIGS. 4A and 4B. The strap device 17 is basically the same as that in the first embodiment except that the first end 11*a* of the strap 11 is secured to the central portion 5*b* of the first guide 3 and the strap 11 is presented between the first guide 3 and the second guide 5 in the form of four layers. In device 17, the other end 11*b* of the strap 11 passes through the slit 7*b* of the first guide 3, the opening 13*c* of the ring 13 and the slit 7*a* toward the second guide 5, and then passes through the slits 9*a* and 9*b* toward the first guide 3. Subsequently, the other end 11*b* passes through the slit 7*b*, the opening (13*c*) of the ring 13 and the slit 7*a* again to finally return to the second guide 5 and passes through the slit 9*a* to reach the position as shown in FIG. 4A.

In the strap device 17, by pulling the clip 20 away from the second guide 5, the second guide 5 approaches the first guide 3 until they contact each other so that the strap is contracted. In order to return the device 17 to the extended length as in the original state, the second guide 5 is pulled apart from the first guide 3 by one hand while holding the mobile-phone 30 in the other hand. As a result, strap 11 is drawn between the first guide 3 and the second guide 5. This strap device 17 realizes a strap extendable to four times the distance between the first guide 3 and the second guide 5. Although the end 11*a* of the strap 11 is connected to the central portion 3*b* of the second guide 5, the end 11*a* may be connected to the central portion 3*b* of the first guide 3. In this case, the ring 13 may be connected to the side of the second guide 5*b*.

Third Embodiment

Figure 5A:
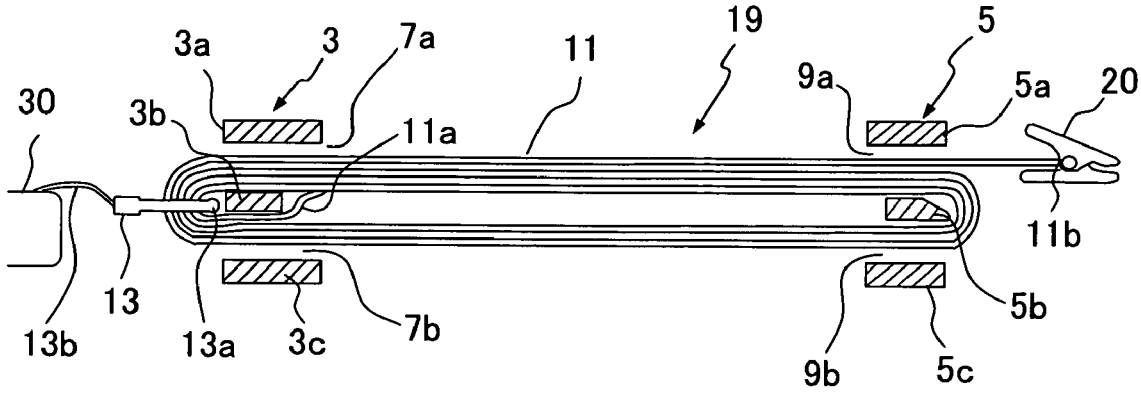
FIGS. 5A and 5B show a sectional view of the strap device which is extendable to five times the contracted length.
Figure 5B:
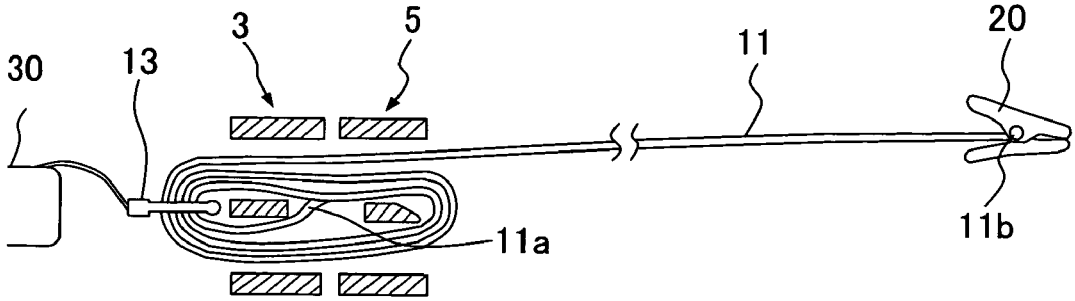

A third embodiment of the strap of the present invention will be explained with reference to FIGS. 5A and 5B. The strap device 19 is basically the same as that in the first embodiment except that strap 11 runs around the first guide 3 and the second guide 5 so as to overlap in five layers. In the device 19, the one end 11*a* of the strap 11 is secured to the first central portion 3*b* and the end 13*a* of the ring 13, and the other end 11*b* of the strap 11 passes through the slits 9*a*,9*b*, the slit 7*b*, the opening (13*c*) of the ring 13 and the slit 7*a* to go around (one round), and then passes through the slits 9*a*, 9*b*, the slit 7*b*, the opening (13*c*) of the ring 13 and the slit 7*a*, to go around (second round), and finally passes through the slits 9*a*, 9*b*, the slit 7*b*, the opening (13*c*) of the ring 13 and the slit 7*a*, to go around (third round), and goes out of the slit 9*a* to reach the position as shown in FIG. 5A. This strap device 19 realizes a strap extendable five times the distance between the first guide 3 and the second guide 5.

The strap device according to the second and third embodiments may omit slider 3. In this case, the strap can go around ring 13 and slider 5, and extension and contraction can be smoothly performed because contact resistance of the strap with the guide can be reduced, in particular in contraction, due to the absence of guide 3.

Fourth Embodiment

Figure 6:
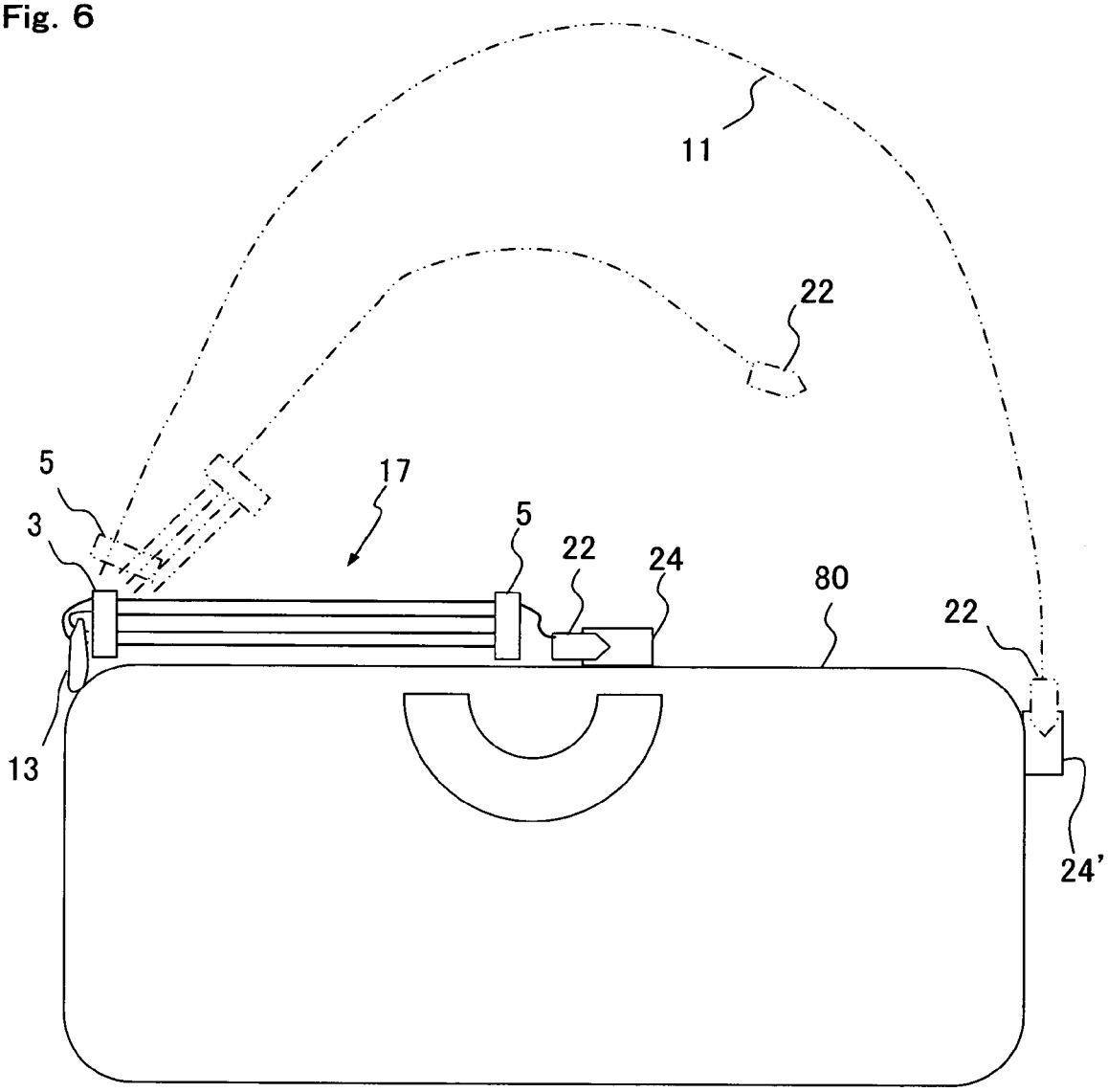
FIG. 6 shows a schematic view illustrating the strap device which is attached to a bag.

In this embodiment, an example in which the strap device 17 of the second embodiment is applied to a bag 80 will be explained with reference to FIG. 6. The ring 13 of the strap device 17 is attached to an end on the upper surface or a side surface on the upper portion of the bag 80. A male part 22 of a buckle is provided on the strap device 17 instead of a clip 20. The buckle is composed of the male part 22 and a female part 24 detachable or lockable to the male part 22. The female part 24 is placed on the upper surface of the bag 80. Further, another female part 24' is attached to an end on the upper surface of the bag 80 which is opposite to the position of ring 13 or the side surface of the upper portion of the bag 80. As shown in FIG. 6, the male part 22 engages with the female part 24 when the strap 11 is shortened to be accommodated. In demand to extend the strap 11, the male part 11 is disengaged with the female part 24 and the strap 11 is pulled out of the strap device 17 by pulling the male part 22.

By this operation, the second guide 5 approaches the first guide 3 to finally contact it. Then, once the male part 22 is engaged with the female part 24', the strap 11 can work as a shoulder strap. When the strap 11 is accommodated, the male part 22 is removed from the female part 24', and the second guide 5 is separated from the first guide 3, and then the male part 22 is engaged with the female part 24. It is possible to shorten or accommodate the strap device to the original length by pulling only the second guide 5 using one hand because the first guide is fixed to the bag 80 via the ring 13. Accordingly, the strap device has excellent operation and fully overcomes the disadvantages of the prior bag with a conventional shoulder strap. An explanation has been made using the strap device according to the second embodiment. However, the strap devices according to the first or third embodiments can be applied to the bag 80.

Modified Embodiments

The first to fourth embodiments can be modified in various ways. For example, the first guide 3 may be omitted to allow the strap 11 to pass through only ring 13 in accordance with the second aspect of the invention. The second aspect of the invention can reduce parts to make it possible to reduce costs. The structure of the bag and strap and members associated thereto disclosed in U.S. Pat. No. 6,669,068 may be applied to the strap device of this invention. The disclosure of U.S. Pat. No. 6,669,068 is incorporated herein by reference.

In development of the second and third embodiments, it is possible to make the strap in the form of six, seven or eight layers by increasing the number of rounds between the guides. As a result, the degree of the extension of the strap can be varied. In this case, it is efficient for the strap device to be modified in order to reduce friction between the strap portions as described later.

Figure 7:
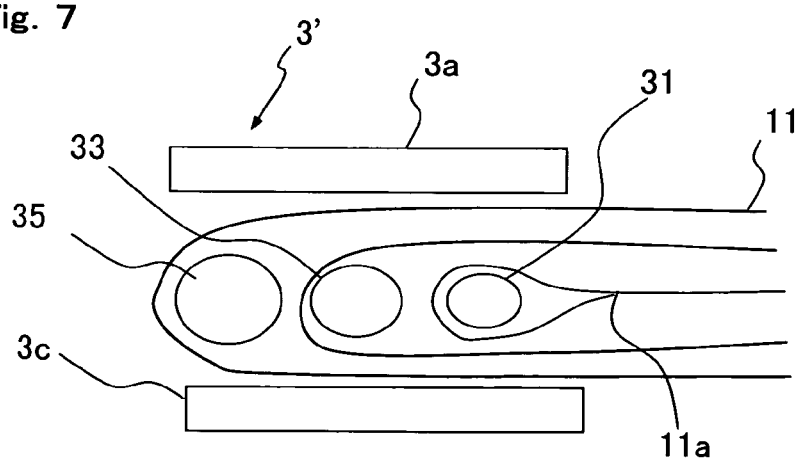
FIG. 7 shows a sectional view of the first guide which has an intermediate part with a divided structure.

In a modified embodiment, the first guide 3 can be modified as shown in FIG. 7, in which the central portion 3*b* is divided into three parts 31, 33 and 35(or two parts). The end 11*a* of strap 11 is secured to the dividing part 31 located nearest to the second guide 5 (shown in FIG. 1A) and the strap 11 goes around the central part 5*b* of the second guide 5 and turns around the middle divided part 33, and turns around the dividing part 35 furthest from the second guide 5 at the final circuit of the strap. By turning around the different dividing parts for each circuit of the strap, the friction caused by the overlapping strap layers (turning portions) can be reduced around guides, so that the strap can be smoothly extended or shortened (accommodated). The dividing structure of the central portion as shown in FIG. 7 may also be used for the central portion of the second guide 5. It is preferable that the dividing parts have circular cross sections, respectively and the diameter of the dividing part 35 is largest in order to reduce the friction.

A roller may be provided on the central portion (or the dividing part) which functions as an axis for the roller. The rotation of the roller can make the sliding of the strap smooth by reducing the friction of the strap on the central portion (or the dividing part).

A lock (key) member for detachably locking the second guide to the clip or buckle may be provided on the second guide and the clip or the buckle in order to maintain the strap in a shortened (accommodated) condition.

The strap device of the present invention may be used as a key chain, a strap for a camera, animal leash, electrical code or harness, jaw strap for a hat or helmet, glasses strap, coat belt, curtains or blind, handle for passengers standing on a train or bus, strap for a guitar or other musical instruments, yachting or camping or various products which require an extendable function. Various information, like design, character or advertisement can be printed or attached to the strap surface. In this case, the information may be put on a predetermined portion which can be seen only when the strap is extended or pulled out.

The strap device of the present invention has an easy to hold ring-like strap and extendable/contractible performance, and is excellent in design and function. The strap device can be extended extremely easily to more than three times the original length when the strap is contracted. The strap can be contracted easily and instantaneously by a one hand operation. Thus, it is suitable not only for a mobile phone strap and a shoulder-bag strap, but any products demanding extension and contraction function.

What is claimed is:

1. An extendable/contractible strap device comprising:

a first guide which is formed with a first slit and a third slit and a first intermediate part defined between the first slit and the third slit;

a strap which has a first end connected to the first intermediate part; and a second guide which is arranged opposite to the first guide and which is formed with a second slit and a fourth slit and a second intermediate part defined between the second slit and the fourth slit, a surface at a side of the second slit of the second intermediate member being inclined with respect to an extending direction of the strap, wherein a second end of the strap passes through the second slit and the fourth slit, returns to the first guide, subsequently passes through the third slit and the first slit of the first guide, returns to the second guide and subsequently passes through the second slit of the second guide.

2. The strap device according to claim 1, wherein the other end of the strap passes the fourth slit again, after passing through the second slit, to return to the first guide and passes through the third slit.

3. The strap device according to claim 2, wherein the other end of the strap passes the first slit, after passing through the third slit, to return to the second guide and passes through the second slit.

4. The strap device according to claim 1, further comprising a ring, wherein the end of the strap passes through the third slit, the ring and the first slit.

5. The strap device according to claim 1 wherein a clip is provided on the other end of strap.

6. A bag comprising a bag body and the strap device defined in claim 1 wherein the strap device is provided on the bag body.

* * * * *